United States Patent [19]

Tytgat et al.

[11] Patent Number: 4,652,340

[45] Date of Patent: Mar. 24, 1987

[54] BATHS AND PROCESS FOR THE CHEMICAL POLISHING OF STEEL SURFACES

[75] Inventors: Daniel Tytgat; Pierre Lefèvre; Michel Maréchal, all of Brussels, Belgium

[73] Assignee: Solvay & Cie (Societe Anonyme), Brussels, Belgium

[21] Appl. No.: 840,749

[22] Filed: Mar. 3, 1986

[30] Foreign Application Priority Data

Mar. 4, 1985 [FR] France ..... 85 03263

[51] Int. Cl.[4] ..... C23F 1/00; B44C 1/22; C03C 15/00; C03C 25/06

[52] U.S. Cl. ..... 156/664; 156/903; 252/79.2

[58] Field of Search ..... 252/79.2, 142, 79.4; 134/3, 41; 156/656, 664, 903

[56] References Cited

U.S. PATENT DOCUMENTS

| | | | |
|---|---|---|---|
| 1,809,041 | 6/1931 | Jenkins et al. . | |
| 2,502,621 | 4/1950 | Fine | 156/664 |
| 2,662,814 | 12/1953 | Swihart | 156/664 |
| 3,072,515 | 1/1963 | Smolinski et al. | 156/664 |
| 3,457,107 | 7/1969 | Mickelson et al. | 156/664 X |
| 4,289,576 | 9/1981 | Wilson et al. . | |

FOREIGN PATENT DOCUMENTS

| | | |
|---|---|---|
| 0019964 | 12/1980 | European Pat Off. . |
| 0025624 | 3/1981 | European Pat. Off. . |
| 1037300 | 9/1953 | France . |
| 2457315 | 12/1980 | France . |
| 2476146 | 8/1981 | France . |

*Primary Examiner*—William A. Powell

*Attorney, Agent, or Firm*—Spencer & Frank

[57] ABSTRACT

The chemical polishing of steel surfaces is carried out by bringing the latter into contact with a bath comprising, in aqueous solution, hydrochloric acid, phosphoric acid, nitric acid and ferricyanide complex ions. The invention is in particular applicable to the polishing of vessels of large dimensions made from stainless steel alloyed with chromium and with nickel.

11 Claims, No Drawings

BATHS AND PROCESS FOR THE CHEMICAL POLISHING OF STEEL SURFACES

The present invention relates to the composition of baths for the chemical polishing of steel surfaces, in particular stainless steel surfaces.

The chemical polishing of metallic surfaces, which is a well-known technique (Polissage électrolytique et chimique des métaux (Electrolytic and Chemical Polishing of Metals)—W. J. Mc G. TEGART—Dunod—1960—p.122 et seq.) consists in treating the metallic surfaces to be polished with baths of inorganic acids (generally a mixture, in aqueous solution, of hydrochloric, phosphoric and nitric acids) containing suitable additives such as surfactants, viscosity regulators and brighteners. Thus, in U.S. Pat. No. 3,709,824, there is provided a composition of a bath for the chemical polishing of stainless steel surfaces which comprises, in aqueous solution, a mixture of phosphoric acid, nitric acid and hydrochloric acid, a viscosity regulator chosen from among water-soluble polymers, a surfactant and sulphosalicylic acid as a brighteners. This known polishing bath has proved very effective. However, it has the disadvantage of containing several organic additives, which add to the cost, complicate its use and constitute a source of pollution when the spent bath is discarded.

A bath of simpler composition, for the chemical polishing of steels, is known, this bath comprising, in aqueous solution, a mixture of hydrochloric acid, phosphoric acid and nitric acid, potassium ferrocyanide and the surfactant OP-7, which is a nonionic surfactant from the family of the alkylphenols (Central Patents Index, Basic Abstracts Journal, section E, Derwent Publications Ltd., London, abstract 13581 U-EM: Soviet author's certificate SU-344035). In use, this known bath has however proved incapable of producing uniform polishing of good quality.

The known polishing baths which have just been described all exhibit the feature of attacking the metal at very high speed. A polishing treatment of a steel surface with such baths may in general not exceed a few minutes since otherwise local corrosion is caused. This high speed of action of the known polishing baths is a disadvantage because it makes them unusable for certain applications, especially for polishing the internal face of the walls of vessels of large dimensions, such as boilers, autoclaves or crystallizers. Since the time required for filling and emptying such vessels is in general much greater than the optimum duration of the chemical polishing treatment, it effectively becomes impossible to achieve a uniform polish of the wall, with certain zones of the latter being insufficiently polished while others are deeply corroded. The high speed of action of the known chemical polishing baths furthermore makes control of the polishing difficult. These known baths are moreover unusable for polishing surfaces in contact with which replacement with fresh bath is difficult, because the polishing results in abrupt changes in the local compositions of the bath.

It is an object of the present invention to overcome the abovementioned disadvantages of the known polishing baths by providing bath compositions for the chemical polishing of austenitic stainless steel surfaces, especially surfaces of steel alloyed with chromium and with nickel, which compositions make it possible to avoid using a plurality of additives, are effective in all types of applications, including the polishing of surfaces of large size or of surfaces to which access is difficult, and permit the achievement of polishes of excellent quality.

Accordingly, the invention relates to baths for the chemical polishing of steel surfaces which baths comprise, in aqueous solution, a mixture of hydrochloric acid, phosphoric acid and nitric acid; according to the invention, the baths comprise ferricyanide complex ions in the aqueous solution.

In the baths according to the invention, the ferricyanide complex ions are complex cyanides of the general formula $[Fe^{III}(CN)_6]^{3-}$, also referred to as hexacyanoferrates (III) (Encyclopedia of Chemical Technology—Kirk-Othmer—John Wiley & Sons, Inc.—1967—Vol. 12—pages 25, 26, 31, 32). They can be present in the aqueous solution in the form of any dissolved compounds such as, for example, hexacyanoferric acid (III), ammonium ferricyanide and alkali metal and alkaline earth metal ferricyanides. Preferred compounds are the alkali metal ferricyanides, potassium ferricyanide being especially recommended.

In the chemical polishing baths according to the invention, the respective proportions of phosphoric, hydrochloric and nitric acids and of ferricyanide complex ions are chosen in accordance with the nature of the treated metal, the working temperature and the desired duration of the polishing treatment. Baths according to the invention which are very suitable for providing chemical polishing of surfaces of stainless steel alloyed with chromium and/or with nickel, within a time of between 2 and 24 hours, are those in which the aqueous solution comprises, per liter, between 1 and 6 mol of hydrochloric acid, between 0.05 and 0.3 mol of phosphoric acid, between 0.005 and 0.5 mol of nitric acid and between $0.3\times10^{-6}$ and 0.3 gram-ion of ferricyanide. In these baths, it is advantageous if the ferricyanide ion content does not exceed 0.1 gram-ion per liter, preferably 0.001 gram-ion per liter. Particularly recommended baths are those in which the global molarity of the mixture of acids in the aqueous solution is between 1 and 7, preferably between 2 and 6. Molarities of between 2.5 and 5 are the most advantageous for the majority of applications. Preferred baths are those in which the aqueous solution comprises, per liter:

hydrochloric acid in an amount of 2.5 to 5 mol, phosphoric acid in an amount of 0.1 to 0.2 mol, nitric acid in an amount of 0.01 to 0.1 mol and potassium ferricyanide in an amount of $0.3\times10^{-5}$ to $2\times10^{-4}$ gram-ion.

Baths recommended for slow polishing at a low temperature, not exceeding 30° C., generally at an ambient temperature of 15° to 25° C., are those in which the aqueous solution comprises, per liter, hydrochloric acid in an amount of at least 3 mol, phosphoric acid in an amount of at least 0.10 mol, nitric acid in an amount of at least 0.05 mol, and potassium ferricyanide in an amount of $0.3\times10^{-4}$ to $1\times10^{-3}$ mol.

The baths according to the invention can optionally contain additives usually present in the known baths for the chemical polishing of metals, such as, for example, surfactants, corrosion inhibitors, viscosity regulators and brighteners. In certain cases, it is preferred that the baths should contain these additives in relative amounts, in relation to a cyanide complex, which respectively do not exceed the following:

1:3 by weight in the case of surfactants of the class of the alkylpyridinium chlorides;

1:1 by weight in the case of surfactants of the class of the alkylphenols;

1:1 in molar terms, in the case of thickeners chosen from among the cellulose ethers.

Preferred baths are those which are substantially free from such additives.

All other factors remaining the same, it has been found that the substitution of ferricyanide ions, according to the invention, for the ferrocyanide ions in the known baths described above (Central Patent Index, Basic Abstracts Journal, section E, Derwent Publications Ltd., London, abstract 13581 U-EM: Soviet author's certificate SU-344035) results in a considerable improvement in the polishing quality. Another advantage of the polishing baths according to the invention resides in their ability, after adaptation of the respective concentrations of their constituents, to effect polishing operations at moderate speeds of action, it being possible to spread the polishing operation over several hours, so as to allow uniform polishing of surfaces of large dimensions or of surfaces which are only accessible with difficulty. They are particularly well suited for polishing metallic surfaces whose area (expressed in $m^2$) can range up to about six times the volume (expressed in $m^3$) of the polishing bath in contact therewith.

In a particular embodiment of the polishing baths according to the invention, the latter contain anions selected from among bromide, iodide and thiocyanate ions. These anions can in general be employed in the form of a bromide, iodide or thiocyanate of an alkali metal, the latter advantageously being sodium. The baths according to this embodiment of the invention have proved particularly advantageous for the polishing of welded assemblies, in the area of the weld seams. The best results are obtained with bromide, iodide or thiocyanate anion contents of between $10^{-5}$ and 1 gram-ion per liter, with contents of between $10^{-4}$ and $10^{-2}$ gram ion per liter being preferred.

The baths according to the invention are suitable for polishing any austenitic stainless steel surfaces. They are applied with particular advantage in polishing austenitic stainless steels alloyed with chromium and with nickel, especially those containing between 12 and 26% of chromium and between 6 and 22% of nickel, such as, for example, 18/8 and 18/10 steels.

The invention hence also relates to a process for polishing a steel surface, according to which the surface is brought into contact with a chemical polishing bath according to the invention.

In the process according to the invention, a prefabricated bath can be employed the metallic surface to be polished subsequently being brought into contact with the said bath.

However, it is preferred to proceed in accordance with a particular embodiment of the process according to the invention which consists in forming the polishing bath in situ in contact with the metallic surface to be polished. To this effect, according to this embodiment of the process according to the invention, the metallic surface is first brought into contact with an aqueous solution of hydrochloric acid, phosphoric acid and nitric acid, after which the ferricyanide complex ions are added to the solution while the latter is in contact with the metallic surface. In performing this embodiment of the process according to the invention, it is advantageous to wait until the metallic surface has undergone substantial attack by the solution of acids before the ferricyanide ions are added thereto; in practice, the time interval between the instant at which the surface to be polished is brought into contact with the solution of acids and the instant at which the ferricyanide complex ions are added to the said solution can advantageously be adjusted so that it corresponds to an attack on the surface, by the solution, to a depth of between 0.1 and 6 microns, preferably between 0.5 and 4 microns.

In the process according to the invention, the contact time of the surface to be polished with the bath must be sufficient to achieve efficient polishing of the surface; however, it must not exceed a critical value beyond which there is a danger of local corrosion appearing on the surface. The optimum contact time depends on numerous parameters such as the metal or alloy of which the surface to be polished consists, the configuration and initial roughness of the surface, the composition of the bath, the working temperature, any possible turbulence of the bath in contact with the surface, and the ratio of the area of the metallic surface to be polished to the volume of the bath employed; the optimum contact time must in each particular case be determined by routine laboratory work.

In a particular embodiment of the process according to the invention, employing a slow-action polishing bath, the surface to be polished is brought into contact with the aqueous solution of acids at a temperature of between 15° and 70° C., preferably 20° and 55° C., the ferricyanide complex ions are added to the said solution after having kept the surface in contact for at least 15 minutes, and thereafter the surface is continued to be kept in contact with the resulting bath for a time at least equal to 1 hour. In this embodiment of the process according to the invention, the addition of the ferricyanide complex ions to the solution of acids can, for example, be made after the surface to be polished has been kept in contact with the said solution for a time of between 30 and 60 minutes, and the resulting bath can thereafter be kept in contact with the surface for a time of between 6 and 24 hours.

The value of the invention will become evident on reading the application examples given below.

EXAMPLE 1

A chemical polishing bath according to the invention was used to polish the internal face of a stainless steel spherical vessel of 6 $m^3$ capacity and 2.4 m diameter, made of stainless steel of type ASTM-316L, which is a steel alloyed with chromium (16.0 to 18.0%), with nickel (10.0 to 14.0%) and with molybdenum (2.0 to 3.0%) (Techniques de L'Ingénieur—Métallurgie (Engineering Techniques——Metallurgy)—M.323A—8 (Table G)—July 1983).

The bath used had the following composition:

Mixture of acids:

| | |
|---|---|
| hydrochloric acid | 2.9 mol/l; |
| phosphoric acid | 0.1 mol/l; |
| nitric acid | 0.01 mol/l; |

Additive: potassium ferricyanide, 20 mg/l.

The bath was introduced into the vessel in an amount of 3.9 l per $dm^2$ of surface to be polished, and was subjected to a stirring movement therein by means of a three-blade stirrer, while keeping the temperature of the bath at between 45° and 50° C.

After 9 hours' treatment, the vessel was emptied and rinsed with demineralized water.

At the end of the treatment, the whole of the internal surface of the vessel proved to be bright and uniformly smooth to the touch.

EXAMPLE 2

A chemical polishing bath according to the invention was used to polish the external surface of the tubes of a stainless steel tubular exchanger of 1.9 m diameter and 6 m length. This exchanger was equipped with 455 tubes of 50 mm diameter and 9 baffles made, like the collar, of stainless steel of type ASTM-304L, which is a steel alloyed with chromium (18.0 to 20.0%) and with nickel (8.0 to 12.0%) (Techniques de L'Ingenieur—Métallurgie (Engineering Techniques—Metallurgy)—M.3-23A—8 (Table G) July 1983).

The bath used had the following composition: Mixture of acids

| | |
|---|---|
| hydrochloric acid | 2.7 mol/l; |
| phosphoric acid | 0.1 mol/l; |
| nitric acid | 0.03 mol/l. |

Additive: potassium ferricyanide, 30 mg/l.

This bath was introduced into a to-and-fro circuit in an amount of 1.3 l per $dm^2$ of surface to be polished and was subjected, in the circuit, to a linear travelling movement over the surfaces to be treated by means of a circulating pump, while keeping the temperature of the bath at between 45° and 50° C. by injection of steam into the interior of the tubes.

After 6 hours' treatment, the circuit was emptied and rinsed with demineralized water.

This bath allowed the external surface of the tube bundle to be polished chemically in a virtually perfect manner.

We claim:

1. Baths for the chemical polishing of steel surfaces which baths comprise, in aqueous solution, a mixture of hydrochloric acid, phosphoric acid and nitric acid, characterized in that the baths comprise ferricyanide complex ions in the aqueous solution.

2. Baths according to claim 1, characterized in that the aqueous solution comprises, per liter, between 1 and 6 mol of hydrochloric acid, between 0.05 and 0.3 mol of phosphoric acid, between 0.005 and 0.5 mol of nitric acid and between $0.3\times10^{-6}$ and 0.3 gram-ion of ferricyanide.

3. Baths according to claim 2, characterized in that the aqueous solution comprises, per liter, between 2.5 and 5 mol of hydrochloric acid, between 0.1 and 0.2 mol of phosphoric acid, between 0.01 and 0.1 mol of nitric acid and between $0.3\times10^{-5}$ and $2\times10^{-4}$ gram-ion of ferricyanide.

4. Baths according to claim 2, characterized in that the aqueous solution comprises, per liter, at least 3 mol of hydrochloric acid, at least 0.10 mol of phosphoric acid, at least 0.05 mol of nitric acid and between $0.3\times10^{-4}$ and $10^{-3}$ mol of potassium ferricyanide.

5. Baths according to claim 1, characterized in that the ferricyanide complex ions are present in the bath in the form of potassium ferricyanide.

6. Baths according to claim 1, characterized in that the global molarity of the mixture of acids in the aqueous solution is between 2 and 6.

7. Baths according to claim 1 characterized in that they contain a surfactant of the class of the alkylpyridinium chlorides, and/or a viscosity regulator of the class of the cellulose ethers, in relative amounts, in relation to the cyanide complex, equal to at most 1:3 by weight in the case of the surfactant and 1:1, in molar terms, in the case of the viscosity regulator.

8. Baths according to claim 1, characterized in that the aqueous solution moreover contains anions selected from among the bromide, iodide and thiocyanate ions, in an amount of between $10^{-5}$ and 1 gram-ion per liter.

9. Process for the polishing of a steel surface, according to which the surface is brought into contact with a chemical polishing bath, characterized in that a bath according to any claim 1 is employed.

10. Process according to claim 9, characterized in that the surface is brought into contact with an aqueous solution of hydrochloric acid, phosphoric acid and nitric acid and ferricyanide complex ions are then added to the solution.

11. Process according to claim 10, characterized in that the time interval between the instant at which the surface is brought into contact with the solution and the instant at which the ferricyanide complex ions are added to the said solution is adjusted so that it corresponds to an attack on the surface by the solution to a depth of between 0.1 and 6 microns.

* * * * *